US006094816A

United States Patent [19]

Doshi

[11] Patent Number: 6,094,816

[45] Date of Patent: Aug. 1, 2000

[54] METHOD OF MAKING A DIMENSIONALLY STABLE TUBE TYPE PLASTIC HEAT EXCHANGERS

[75] Inventor: Shailesh Doshi, Kingston, Canada

[73] Assignee: E. I. du Pont de Nemours and Company, Wilmington, Del.

[21] Appl. No.: 08/922,913

[22] Filed: Sep. 3, 1997

Related U.S. Application Data

[60] Provisional application No. 60/026,110, Sep. 11, 1996.

[51] Int. Cl.[7] ..... B23P 15/26

[52] U.S. Cl. ..... 29/890.043; 29/890.044

[58] Field of Search ..... 29/890.043, 890.035, 29/890.044; 264/292, 291

[56] References Cited

U.S. PATENT DOCUMENTS

| | | | |
|---|---|---|---|
| 4,577,380 | 3/1986 | Warner | 29/890.043 |
| 4,923,004 | 5/1990 | Fletcher et al. | 165/175 |
| 4,955,435 | 9/1990 | Shuster et al. | 165/170 |
| 5,078,946 | 1/1992 | Fletcher et al. | 264/292 |
| 5,469,915 | 11/1995 | Cesaroni | 165/171 |
| 5,499,676 | 3/1996 | Cesaroni | 165/166 |

FOREIGN PATENT DOCUMENTS

| | | |
|---|---|---|
| 0 277 376 | 8/1988 | European Pat. Off. . |
| 0 291 322 | 11/1988 | European Pat. Off. . |
| 0 469 435 | 2/1992 | European Pat. Off. . |
| WO 89/10948 | 11/1989 | WIPO . |
| WO 94/20564 | 9/1994 | WIPO . |

*Primary Examiner*—I. Cuda
*Attorney, Agent, or Firm*—R. H. Burgess

[57] ABSTRACT

Plastic tube-type heat exchanger structures are made with partially crystallized partially aromatic polyamides of high glass transition temperature. The structures are then annealed to further crystallize the polyamides, causing shrinkage and building up residual tensile stresses. These stresses counteract the swelling caused by water absorption and temperature rise during use of the heat exchanger and keep the structures dimensionally stable.

1 Claim, 1 Drawing Sheet

METHOD OF MAKING A DIMENSIONALLY STABLE TUBE TYPE PLASTIC HEAT EXCHANGERS

This application claims benefit of provisional application 60/026,110, filed Sep. 11, 1996.

BACKGROUND OF THE INVENTION

This invention relates to heat exchangers, specifically tube-type heat exchangers made using tubes made from thermoplastic compositions, a major portion of which comprises certain types of partially aromatic polyamides or copolyamides, and a process to manufacture these heat exchangers.

Heat exchangers fabricated from metals are well known, and are used in a wide variety of automotive and other transportation vehicles, chemical processing, air conditioning, and refrigeration end-uses where there is a need to exchange heat between two fluid streams without bringing them into direct contact with each other. Metals have the advantage that they provide rapid conduction of heat through the wall, and generally posses high stiffness and strength properties. However, they are subject to corrosion from chemical attack. Engineering thermoplastics, especially polyamides, possess good chemical resistance and stiffness and strength properties at elevated temperatures. It is thus desirable to construct heat exchangers out of these thermoplastic materials.

Heat exchangers formed from thermoplastics, and methods for their manufacture are known. For example, U.S. Pat. Nos. 4,955,435; 5,469,915 and 5,499,676 disclose a number of panel heat exchangers formed from thermoplastics, preferable polyamides. U.S. Pat. Nos. 4,923,004 and 5,078,946 disclose a comfort heat exchanger made from a thermoplastic, preferably a polyamide, and a method to manufacture it.

Tube-Type Thermoplastic Heat Exchangers

The present invention relates to a tube-type exchanger formed from thermoplastics. These heat exchangers consist of structures where a multitude of tubes running lengthwise are arranged in a spaced apart manner and are integrally bonded to two manifolds at their ends. The manifolds are provided with a fluid inlet through which a first fluid enters and flows though the tubes, and a fluid outlet through which this first fluid exits. A second fluid flows around the tubes on their outside such that heat exchange is facilitated between the first and the second fluids across the wall of the tubes. Direct contact between the fluids is prevented by the tube walls and construction of the manifolds.

In cases where the second fluid requires containment, a thermoplastic shell may be provided that extends between the two manifolds enveloping the tubes and is in flow communication with the inlets and outlets for the second fluid. If the second fluid does not require containment, as in the case of ambient air, it is not necessary to provide a shell.

DESCRIPTION OF THE PROBELM

Tube-type heat exchangers with tubes constructed out of polyamides suffer from one drawback. Upon absorption or desorption of moisture or other polar chemicals such as alcohols, the tubes exhibit dimensional changes. Depending on the design and exposure conditions, these dimensional changes are often non-uniform, i.e., some tubes exhibit larger dimensional changes than others. Dimensional changes can also occur due to thermal expansion/ contraction, and depending on temperature gradients, these changes can be non-uniform as well. In a heat exchanger structure with constrained span between the manifolds, the longer tubes develop bends and curves to accommodate the different length. This phenomenon has the following negative consequences:

(a) It leads to poor appearance of the heat exchanger (b) It creates gaps between the tubes through which the external fluid can bypass, and thus significantly reduce the overall heat transfer performance.

BRIEF DESCRIPTION OF THE DRAWINGS

A tube-type heat exchanger without a shell is illustrated in FIG. 1, th esole figure of the drawing, where element 1 are the tubes arranged lengthwise between manifolds 2 and 3. Element 4 is a frame which provides structural support to the unit, and maintains the span of the tubes between the two manifolds.

SUMMARY OF THE INVENTION

Figure 1:
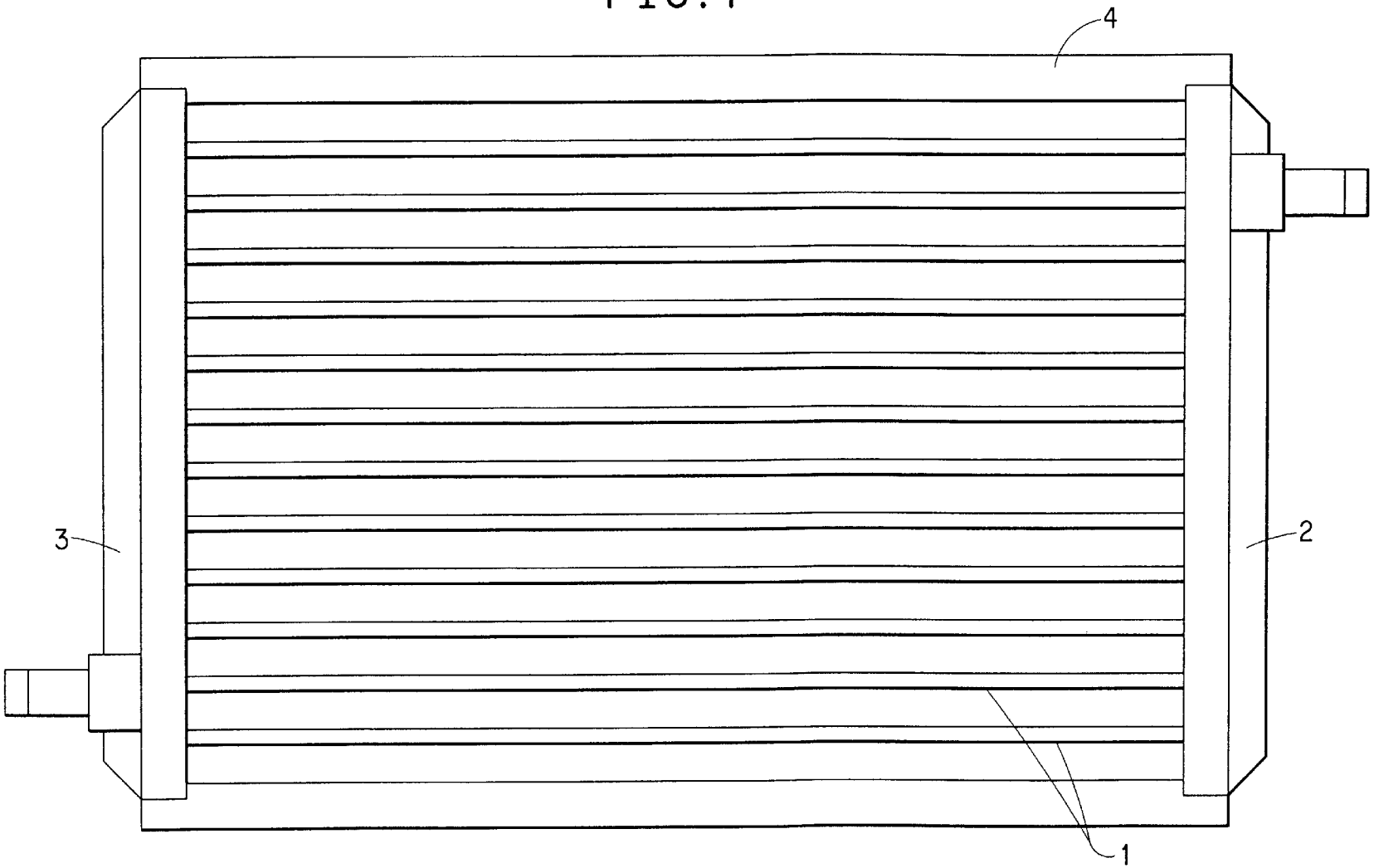

The present invention provides a tube for use in a heat exchanger, said tube being made from a thermoplastic composition, which composition comprises at least 50% by weight partially aromatic melt processable polyamides or copolyamides made from aliphatic and aromatic monomers with, on a molar basis, 25% to 65% of the monomers being aromatic and wherein, polyamide or copolyamide has a glass transition temperature of 65° C. or higher.

The invention also provides heat exchanger made from such tube and a process for manufacturing a tube-type plastic heat exchanger in which curving and bending of the tubes that can occur in service environments due to pickup or loss of moisture or polar chemicals and thermal expansion is prevented.

DETAILED DESCRIPTION

A solution has been found to the above problem by making heat exchanger tubes out of certain types of partially aromatic melt processable polyamides or copolyamides that have relatively high glass transition temperature. When these polymers are melt formed into tubing, and quenched, they attain only a fraction of the total crystallinity that they are capable of attaining. Also, they possess a relatively high level of residual stress resulting from the forming process. Annealing of these tubes at a temperature above their glass transition temperature causes relaxation of the residual stress and further crystallization of the material. These process lead to shrinkage in tubing dimensions.

In various aspects, the invention involves:

(a) constructing a tube-type heat exchanger using tubing made from thermoplastic compositions, a major portion of which comprises the above-described polyamides/copolyamides. The tubing has only a fraction of the total crystallinity that the polyamide is capable of attaining, and can have a significant level of residual stress resulting from the tube forming process. The heat exchanger is constructed with a rigid frame such that the span of the tubes between the two manifolds is fixed to a predetermined length.

(b) subjecting the heat exchanger to an annealing treatment by exposing it to an appropriate temperature above the glass transition temperature of the polyamide. The annealing temperature can be substantially above the glass transition temperature in order for annealing to be completed in a shorter duration of time.

Annealing causes the polyamide/copolyamide to crystallize further and relieve the residual stress present in the tubing from the forming process. As a result of these processes, the tubing undergoes contraction. However, since the span of the tubes between the two manifolds is fixed to the predetermined length, the contraction introduces tension in the assembly. The amount of contraction is dependent upon the specific type of polyamide used and the degree of crystallinity and residual stress in the tubing prior to the annealing step. It is important to choose the polymers and design the assembly such that the amount of contraction upon annealing is larger than the maximum amount of expansion that is expected to occur in the service environment, yet not so high that the resulting tension could cause failure of the tubes or tube-to-manifold bonds. In the present invention, it is desirable that the amount of contraction upon annealing is in the range of 1 to 5 times the magnitude of the maximum amount of potential expansion that can occur when dry tubes become saturated with water. Also, annealing should be done in such a way that all the tubes are heated uniformly, and thus are able to contract at a uniform rate. If this is not achieved, some tubes may anneal and contract faster than others, and could cause buckling of the longer tubes.

When such a heat exchanger is put into service, the tubes would undergo expansion due to absorption of moisture or other polar chemicals and/or temperature rise encountered in the service environment. However, this expansion simply leads to relaxation of some of the tension built up by the annealing process as opposed to causing bends and curves in the tubes. The exchanger is thus able to retain its appearance and heat transfer performance in the service environment.

Partially Aromatic Melt Processable Polyamides and Copolyamides

Partially aromatic melt processable polyamides or copolyamides used in the present invention are polymers formed from aliphatic and aromatic monomers such as diamines, dicarboxylic acids or their derivatives, aminocarboxylic acids and lactams such that, on a molar basis, at least 25% of the monomers are aromatic in nature.

Examples of aliphatic diamines are hexamethylene diamine, 2-methyl pentamethylene diamine, 1-4 diaminobutane, 2-2-4 trimethylhexamethylene diamine, 2-2-4 trimethylpentamethylene diamine, 5-amino-1-3-3-trimethylcyclohexane methylamine, bis-aminomethyl cyclohexane etc. Examples of aromatic diamines are m-xylene diamine, p-xylene diamine, m-phenylene diamine, and p-phenylene diamine.

Examples of aliphatic dicarboxylc acids are adipic acid, sebacic acid, dodecanedioic acid, etc. Examples of aromatic dicarboxylic acids and their derivatives are terphthalic acid, isophthalic acid, dimethyl terphthalate, and 2-6 naphthalene dicarboxylic acid.

Examples of aliphatic aminocarboxylic acids include 11 -aminodecanoic acid, and 4-aminocyclohexyl acetic acid. Examples of aromatic aminocarboxylic acids include p-aminomethyl benzoic acid, 4-aminophenyl acetic acid.

Examples of aliphatic lactams are caprolactam, laurolactam, and bicyclic endoethylene caprolactam. An example of aromatic lactam is oxinadole.

These polyamides and copolyamides have high glass transition temperature such as about 65° C. or higher. There are several ways of analytically determining the glass transition temperature of polymers. One method uses dynamic mechanical analysis (DMA) of polymer samples. In the following data, the temperature at which the storage modulus in dynamic mechanical analysis (DMA) exhibits a change in slope is used to indicate the glass transition temperature.

It is desirable that the molar aromatic content of the monomers used in forming a polyamide or a copolyamide be below 65%. At higher aromatic content, the melting point of the polymer is too high to be melt processable. Also, such a polymer is likely to have low overall degree of crystallinity, and thus, will not exhibit adequate contraction upon annealing.

Table I lists several such partially aromatic polyamides and copolyamides along with their constituent monomers, their molar aromatic content, and approximate glass transition temperatures. Some aliphatic polyamides are also listed for comparison.

TABLE I

| Polyamide/Copolyamide | Monomer (molar ratio) | Glass Trans. Temp. (° C.) | Molar Aromatic Content (%) |
|---|---|---|---|
| | Partially Aromatic Polyamides/Copolyamides | | |
| 6T/DT (50/50) | HMD(50):2-MPMD(50):TPA(100) | 125 | 50 |
| 6T/DT (55/45) | HMD(55):2-MPMD(45):TPA(100) | 127 | 50 |
| 6T/DT (30/70) | HMD(30):2-MPMD(70):TPA(100) | 135 | 50 |
| 6T/66 (55/45) | HMD(100):TPA(55):AA(45) | 80 | 27.5 |
| 6T/66 (65/35) | HMD(100):TPA(65):AA(35) | 76 | 32.5 |
| 10T | DMD(100):TPA(100) | 100 | 50 |
| 12T | DDMD(100):TPA(100) | 85 | 50 |
| 6T/6 (70/30) | HMD(70):TPA(70):CAPRO(30) | 85 | 41.2 |
| 6T/DT/612 (55/10/35) | HMD(90):2-MPMD(10):TPA(65): DDDA(35) | 65 | 32.5 |
| 6T/DT/612 (50/25/25) | HMD(75):2-MPMD(25):TPA(75): DDDA(25) | 75 | 37.5 |
| 6T/DT/610(55/10/35) | HMD(90):2-MPMD(10):TPA(65): DDDA(35) | 66 | 32.5 |
| 6T/DT/610(50/30/20) | HMD(70):2-MPMD(30):TPA(80): AA(20) | 103 | 40 |
| 6T/61/66 (65/25/10) | HMD(100):TPA(65):IPA(25): AA(10) | 105 | 45 |
| MXD6 | MXD(100):AA(100) | 102 | 50 |
| TMDT | TMD(100):TPA(100) | 148 | 50 |
| | Aliphatic Polyamides | | |

TABLE I-continued

| Polyamide/Copolyamide | Monomer (molar ratio) | Glass Trans. Temp. (° C.) | Molar Aromatic Content (%) |
|---|---|---|---|
| 66 | HMD(100):AA(100) | 48 | 0 |
| 612 | HMD(100):DDDA(100) | 45 | 0 |
| 6 | Epsilon Capro (100) | 41 | 0 |

In the previous Table, the following abbreviations have been used:

| | |
|---|---|
| HMD | Hexamethylene diamine |
| 2-MPMD | 2-Methyl pentamethylene diamine |
| TPA | Terephthalic acid |
| AA | Adipic Acid |
| DMD | Decamethylene diamine |
| DDMD | Dodecamethylene diamine |
| Capro | Caprolactam |
| DDDA | Dodecanedioic acid |
| DDA | Decanedioic acid |
| IPA | Isophthalic acid |
| MXD | Metaxylene diamine |
| TMD | Trimethy hexamethylene diamine |
| 6T | polymer molecular unit formed from HMD and TPA |
| DT | polymer molecular unit formed from 2-MPMD and TPA |
| 66 | polymer molecular unit formed from HMD and AA |
| 10T | polymer molecular unit formed from DMD and TPA |
| 12T | polymer molecular unit formed from DDMD and TPA |
| 6 | polymer molecular unit formed from Capro |
| 612 | polymer molecular unit formed from HMD and DDDA |
| 610 | polymer molecular unit formed from HMD and DDA |

It should be noted that the above polyamides/copolyamides may be used by themselves or in compositions with other polymers where they form the major portion of the polymeric formulation. Also, they may be modified by the incorporation of toughening agents, melt viscosity enhancers, reinforcements, filters, and other additives to enhance their melt viscosity, processability, thermal/oxidative/chemical stability, physical properties and mechanical properties. For example, additives with reactive functional groups such as epoxy, acid or anhydride are often used to enhance melt viscosity of polyamides. Elastomeric materials with such functional groups are often used to enhance toughness properties of polyamides. Glass fibers, particulate minerals, etc. may be used to enhance stiffness and strength properties of polyamides. A common way of preparing these compositions involves melting and mixing the ingredients in appropriate proportions in an extruder, preferable a twin screw extruder.

Tubes Formed from Partially Aromatic Melt Processable Polyamides or Copolyamides:

Polymeric formulations based on the above-described partially aromatic melt processable polyamides or copolyamides may be formed into tubing by known techniques. A typical process involves plasticating the material into melt in an extruder, and extruding the melt through a die that has an annular opening of appropriate dimensions. The melt tube exiting from the die enters a water quenching bath where it solidifies. In case of small diameter tubing, dimensions of the tubing can be controlled by blowing air through the die into the tubing, and an open water tank can be used for quenching. Alternatively, vacuum sizing is used where vacuum is applied in the quench tank with or without blowing air into the tubing. In the latter case, a sizer designed in the form of a short metal tube with an internal diameter corresponding to the desired outer diameter of the plastic tubing is used at the inlet to the quench tank to solidify the melt tubing to the desired dimensions.

Because of the high glass transition temperature, the tubing made out of the above-described thermoplastic polyamides or copolyamides develops only a fraction of the crystallinity that the polyamide is capable of attaining. The tubing is also likely to have a significant level of residual stress resulting from the tube forming process. An annealing step is required for the tubing to develop its complete crystallinity, and relieve the residual stress. The tubing undergoes contraction upon annealing. The amount of contraction is dependent upon the specific type of polyamide used, degree of crystallinity and residual stress in the tubing prior to the annealing step. To be useful in the present invention, it is important to choose the polymer formulations and form them into tubing such that the amount of contraction upon annealing is larger than the maximum amount of expansion that is expected to occur in the service environment, yet not so high that the resulting tension could cause failure of the tubes or tube-to-manifold bonds in a fabricated heat exchanger. Specifically, it is desirable that the amount of contraction upon annealing is in the range 1 to 5 times the magnitude of the maximum amount of expansion that can potentially occur when dry tubes become saturated with water.

Dimensionally Stable Tube-Type Plastic Heat Exchanger:

A tube-type plastic heat exchanger is constructed by arranging a multitude of tubes lengthwise in a spaced apart manner between two manifolds, and integrally connecting them to the manifolds. The tubes can be connected to the manifolds using suitable bonding techniques such as adhesive bonding or welding.

The invention involves:

(a) constructing a tube-type heat exchanger using tubing made from thermoplastic formulations based on the above described polyamides/copolyamides. The tubing has only a fraction of the total crystallinity that the polyamide is capable of attaining, and may have a significant level of residual stress resulting from the tube forming process. The heat exchanger is constructed with a rigid frame such that the span of the tubes between the two manifolds is fixed to a predetermined length.

(b) subjecting the heat exchanger to an annealing treatment by exposing it to an appropriate temperature above the glass transition temperature of the polyamide. The annealing temperature can be substantially above the glass transition temperature in order for annealing to be completed in a shorter duration of time.

Annealing causes the polyamide/copolyamide to crystallize further and relieve the residual stress present in the tubing from the forming process. As a result of these process, the tubing undergoes contraction. However, since the span of the tubes between the two manifolds is fixed at a predetermined length, the contraction introduces tension in the assembly. The amount of contraction is dependent upon the specific type of polyamide used, degree of crystallinity and residual stress in the tubing prior to the annealing step. It is important to choose the polymers and design the assembly such that the amount of contraction upon annealing is larger than the maximum amount of expansion that is expected to occur in the service environment, yet not so high that the resulting tension could cause failure of the tubes or tube-to-manifold bonds. Also, annealing should be done in such a way that all of the tubes are heated uniformly, and thus are able to contract at a uniform rate. If this is not achieved, some tubes may anneal and contract faster than others, and could cause buckling of the longer tubes.

When such a heat exchanger is put into service, the tubes would undergo expansion die to absorption of moisture or other polar chemicals and/or temperature rise encountered in the service environment. However, this expansion simply leads to relaxation of some of the tension built up by the annealing process as opposed to causing bends and curves in the tubes. The exchanger is thus able to retain its shape and appearance, and its heat transfer performance in the service environment.

Parts, proportions and percentages herein are by weight except where indicated otherwise.

EXAMPLE 1

Materials based on a high molecular weight aliphatic polyamide, namely 66, and a partially aromatic copolyamide, namely 6T/DT (50/50) were used to make heat exchanger tubing with an outside diameter of about 3.65 mm and wall thickness of 0.19–0.22 mm.

66 has a low glass transition temperature of about 48° C. Tubing made out of thie material was expected to attain essentially its full crystallinity during the extrusion quenching step. Also, the residual stress level in the tubing was expected to be relatively low. The copolyamide 6T/DT (50/50) was toughened with approximately 15% functionalized and 5% non-functionalized ethylene-propylenehexadiene elastomers. The functionalized toughener was grafted with about 1.75% maleic anhydride by weight. This copolyamide has a relatively high glass transition temperature of about 125° C. As a result, during the extrusion quenching step, the tubing made out of this material is capable of achieving. It was also expected to have a high level of residual stress.

The additional degree of crystallinity that a material is capable of attaining upon annealing, and the level of residual stress in the tubing can be assessed by measuring the amount of contraction associated with the annealing treatment. For this purpose, representative tubing samples of the above materials were subjected to an annealing treatment by exposing them to a temperature of 180° C. for five minutes in Nitrogen environment, and change in their lengths were measures after cooling to room temperature. Also, dimensional change in the annealed samples upon pickup/loss of water was characterized by subjected them to repeated moisture conditioning and drying treatments, and calculating an average change in length associated with going from a dry to a near-saturated state. These results are summarized in Table 2.

TABLE 2

| Material | Composition | Contraction Upon Annealing (mm/m of tubing) | Expansion Upon Moisture Absorption of Annealed Tubes going from dry to near-saturated state (mm/m of tubing) |
|---|---|---|---|
| I | 66 | 6.4 | 22.0 |
| II | Toughened 6T/DT (50/50) | 45.4 | 16.8 |

The results confirm the expectation that upon extrusion quenching, 66 tubing attained substantially all of its crystallinity, and had a relatively low level of residual stress, while toughened 6T/DT (50/50) tubing only achieved a fraction of its attainable crystallinity and had a high level of residual stress.

It is worth noting that contraction due to annealing of tubes made out of toughened 6T/DT polymer is about 2.7 times the maximum amount of expansion that is likely to occur due to moisture saturation.

The dimensional change due to thermal expansion resulting from a rise in temperature of 23° C. to 100° C. for the tubing of both materials is estimated to be of the order of 8.3 mm/m. Thus, for a service environment involving a temperature of 100° C. and humidity-saturated state, the contraction due to annealing for the toughened 6T/DT (50/50) tubing is about 1.8 times the magnitude of the total expansion that could potentially occur due to both moisture pickup and temperature rise.

A tube-type heat exchanger approximately 0.74 m wide by 0.33 m high by 0.09 m thick was constructed from 66 tubing by arranging 329 tubing pieces horizontally between two manifolds capturing a span of 0.71 m. This exchanger was not annealed since the above data showed that its tubing had substantially achieved all of its potential crystallinity and the level of residual stress in the tubing was relatively low. The frame of the exchanger was provided with tensioning springs so as to maintain tension against potential expansion in the tubes. It was tested in a service type environment by circulating about 65° C. hot water inside the tubes and air around them. In spite of the tensioning springs in the frame, within a few hours, some of its tubes developed bends and curves due to non-uniform growth.

A similar exchanger was constructed from toughened 6T/DT (50/50) tubing. Its frame was designed such that one manifold could move inwards by 6.4 mm in response to 0.704 m. No tensioning springs were provided in this heat exchanger. Upon fabrication, the whole exchanger was annealed at 185° C. for 10 minutes in an oven. Upon annealing, the moveable tubesheet pulled in through the allowed distance, and all of the tubes felt quite tight. None of the tubes showed any sign of buckling, indicating that the annealing had occurred in a uniform manner. The exchanger was tested in a service type environment as described above. Hot water at about 65° C. was circulated during the day time allowing the tubes to absorb moisture, while circulation was stopped during the night time allowing the tubes to dry out. The test lasted for more than 21 days. Throughout the test, the tubes stayed straight, and did not develop any curves or bends.

EXAMPLE 2

Three polymeric formulations were prepared using a partially aromatic copolyamide 6T/DT (30/70) as follows.

| Material | Composition (by weight %) |
|---|---|
| III | 95% 6T/DT (30/70 + 5% styrene maleic anhydride copolymer |
| IV | 80% 6T/DT (30/70 + 15% ethylene-propylene-hexadiene elastomer functionalized with 1.75% maleic anhydride + 5% ethylene-propylene-hexadiene elastomer |
| V | 85% 6T/DT (30/70) + 5% styrene-maleic anhydride copolymer + 6.7% ethylene-propylene-hexadiene elastomer functionalized 1.75% maleic anhydride + 3.3% ethylene-propylene-hexadiene elastomer |

Tubes with an outside diameter of about 3.65 mm and wall thickness of about 0.19–0.22 mm were made from above materials by extrusion and quenching. Representative tubing samples were subjected to an annealing treatment at 205° C. for 5 minutes in a nitrogen atmosphere, and the amount of contraction was measured as described in Example 1. Also, the dimensional change due to absorption from almost dry to near saturated state was characterized as described in Example 1. The results of these measurements are presented in Table 3.

TABLE 3

| Material | Contraction upon Annealing (mm/m of tubing) | Expansion upon moisture absorption of annealed tubes going from almost dry to near saturated state (mm/m of tubing) |
|---|---|---|
| III | 190 | 21.2 |
| IV | 262 | 21.6 |
| V | 272 | 18.6 |

The results show that the amount of contraction upon annealing in these tubes is about 9 to 14 times the maximum amount of expansion that could occur due to moisture pickup. This amount of contraction is quite large, and would require appropriately designed structures or geometrics in a heat exchanger to ensure that the contraction due to annealing occurs in a uniform manner, and does not lead to excessive tensioning of the assembly. This can be accomplished, for instance, by designing the manifold and heat exchanger frame assembly such that one of he manifolds is moveable through a predetermined distance before tensioning of the assembly begins.

EXAMPLE 3

Several polymeric formulations were prepared using a partially aromatic copolyamide, 6T/DT (50/50), an aliphatic polyamide, N66, styrene-maleic anhydride copolymer (SMA) and toughners based on ethylene-propylene-hexadiene elastomer either functionalized with 1.75% maleic anhydride (MA-g-EPDM) or in non-functionalized (EPDM) form. The partially aromatic copolyamide 6T/DT (50/50) formed the major portion of each formulation.

| Material | Composition |
|---|---|
| VI | 70% 6T/DT (50/50) + 10% N66 + 15% MA-g-EPDM |
| VII | 75% 6T/DT (50/50) + 10% N66 + 5% SMA + 6.7% MA-g-EPDM + 3.3% EPDM |
| VIII | 65% 6T/DT (50/50) + 10% N66 + 5% SMA + 15% MA-g-EPDM + 5% EPDM |
| IX | 60% 6T/DT (50/50) + 20% N66 + 15% MA-g-EPDM + EPDM |
| X | 65% 6T/DT (50/50) + 20% N66 + 5% SMA + 6.7% MA-g-EPDM + 3.3% EPDM |
| XI | 65% 6T/DT (50/50) + 20% N66 + 2 5% SMA + 8.5% MA-g-BPDM + 4% EPDM |
| XII | 50% 6T/DT (50/50) + 30% N66 + 15% MA-g-EPDM + 5% EPDM |
| XIII | 60% 6T/DT (50/50) + 30% N66 + 5% SMA + 5% MA-g-EPDM |
| XIV | 55% 6T/DT (50/50) + 30% N66 + 5% SMA + 6.7% MA-g-EPDM + 5% EPDM |
| XV | 45% 6T/DT (50/50) + 30% N66 + 5% SMA + 15% MA-g-EPDM + 5% EPDM |

Tubings with an outside diameter of about 3.65 mm and wall thickness of about 0.19–0.22 mm were made from the above material by extrusion and quenching. Representative samples of these tubings were subjected to an annealing treatment at 190° C. for about 10 minutes in a Nitrogen environment, and the amount of contraction was measured as described in Example 1. Also, the dimensional changes due to moisture absorption from almost dry to near saturated state was characterized for each material as described in Example 1. The results are presented in Table 4.

TABLE 4

| Material | Contraction upon Annealing (mm/m of tubing) | Expansion upon moisture absorption of annealed tubes going from almost dry to near saturated state (mm/m of tubing) |
|---|---|---|
| VI | 28.5 | 15.5 |
| VII | 19.8 | 14.2 |
| VIII | 31.3 | 13.8 |
| IX | 55.3 | 18.3 |
| X | 59.0 | 15.8 |
| XI | 38.0 | 17.3 |
| XII | 25.2 | 21.4 |
| XIII | 54.7 | 17.3 |
| XIV | 37.5 | 18.9 |
| XV | 39.2 | 18.3 |

The results show that all of the above materials exhibit contraction upon annealing in the range of 1.2 to 3.7 times the maximum amount of expansion that is likely to occur due to moisture saturation. In a properly designed tube-type heat exchanger, these materials would thus enable one to impart tension in the tubes by the annealing technique described here, and thus retain appearance and heat transfer performance of the heat exchanger.

The thermal expansion due to an increase in temperature from 23° C. to 100° C. for these tubes is estimated to be of the order of 83.3 mm/m. In case of materials VII and XII, the amount of contraction due to annealing is larger than the maximum amount of expansion that could occur due to moisture pickup. In applications where large thermal expansion is not expected, these materials would be adequate to use. In applications where thermal expansion of the above magnitude is expected to accompany the expansion due to moisture saturation, the tension built up by the above annealing technique may not be adequate to retain the appearance of the tubes against the total expansion.

EXAMPLE 4

Polymeric formulations were prepared by compounding 5% and 10% by weight of a liquid crystalline copolymer (LCP) viz. Poly (4,4'-buphenldiol/hydroquinone/4-hydroxybenzoic acid/terephthalic acid/2,6-naphthalene dicarboxylic acid/6-hydroxy-2-naphthalene carboxylic acid/acetic anhydride) as reinforcing agent into the toughened partially aromatic copolyamide of Example 1 (material II). Tubes with an outside diameter of about 3.65 mm and wall thickness of 0.19–0.22 mm were made from these materials by extrusion and quenching. During the extrusion process, LCP is expected to form reinforcing fibrils inside the copolyamide matrix. Representative samples were subjected to an annealing treatment at 190° C. for about 10 minutes in a Nitrogen environment, and the amount of contraction was measured as described in Example 1. Also, the dimensional changes due to moisture absorption form almost dry to near saturated state was characterized for each material as described in Example 1. The results are presented in Table 5.

TABLE 5

| Material Moisture Annealed | Composition (by weight) | Contraction upon Annealing (mm/m of tubing) | Expansion upon moisture absorption of annealed tubes going from almost dry to near saturated state (mm/m of tubing) |
|---|---|---|---|
| XVI | Toughened 6T/DT (50/50) + 5% LCP | 34.1 | 13.1 |
| XVII | Toughened 6T/DT (50/50) + 10% LCP | 24.3 | 11.1 |

It is interesting to note that the contraction of these tubes due to annealing is somewhat smaller than that for the tubing made out of toughened 6T/DT (Material II) that did not have any LCP. This may be because presence of LCP promotes crystallization of the copolymer prior to quenching so that the amount of additional crystallization resulting upon annealing is lower. Also, the expansion of these tubes due to moisture absorption is smaller than that for the tubing made out of toughened 6T/DT (Material II). This is likely to be due to reinforcing effect of the LCP fibrils.

The results show that the above materials exhibit contraction due to annealing that is 2.2 to 2.6 times the expansion die to moisture pickup. Also, because of the reinforcing effects of LCP fibrils, thermal expansion in these material due to a rise in temperature of 23° C. to 100° C. is expected to be smaller than 8.3 mm/m estimated to be for materials that do not have LCP reinforcement. In a properly designed tube-type heat exchanger, these materials can be used in conjunction with the annealing technique described here to impart tension in the tubing, and hence, maintain the appearance and heat transfer performance of the heat exchanger.

What is claimed is:

1. A process for manufacturing a tube-type plastic heat exchanger in which curving and bending of the tubes that can occur in service environments due to pickup or loss of moisture or polar chemicals and thermal expansion is prevented by:

(a) providing tubes made from a thermoplastic composition, which composition comprises at least 50% by weight partially aromatic melt processable polyamides or copolyamides made from aliphatic and aromatic monomers with, on a molar basis, 25% to 65% of the monomers being aromatic, and wherein said polyamide or copolyamide has a glass transition temperature of 65% or higher, such tubes having the property that when as-formed, unannealed tubes are subjected to an annealing treatment at a temperature above the glass transition temperature of the polyamide or copolyamide, they exhibit shrinkage that is about 1 to 5 times in magnitude compared to the maximum amount of potential expansion that would occur in dry tubes when they become saturates with water;

(b) arranging the as-formed, unannealed tubes lengthwise in a spaced apart manner between two manifolds, and integrally connecting the ends of the tubes to the two respective manifolds;

(c) said heat exchanger having a rigid frame such that the span of the tubes between the two manifolds is fixed at a predetermined length; and (d) subjecting the heat exchanger to an annealing treatment at a temperature above the glass transition temperature of the polyamide or copolyamide so as to create pre-stressing in the tubes due to contraction against the rigid frame.

* * * * *